US005557909A

United States Patent [19]

Boyhan

[11] Patent Number: 5,557,909

[45] Date of Patent: Sep. 24, 1996

[54] APPARATUS AND PROCESS FOR PACKAGING ARTICLES

[75] Inventor: Laurence A. Boyhan, Lower Templestowe, Australia

[73] Assignee: Gradual Pty, Ltd., Melbourne, Australia

[21] Appl. No.: 343,493

[22] PCT Filed: May 26, 1993

[86] PCT No.: PCT/AU93/00244

§ 371 Date: Jan. 23, 1995

§ 102(e) Date: Jan. 23, 1995

[87] PCT Pub. No.: WO93/24372

PCT Pub. Date: Dec. 9, 1993

[51] Int. Cl.[6] ..... B65B 5/08; B65B 35/32

[52] U.S. Cl. ..... 53/474; 53/243; 53/255; 53/448; 53/539

[58] Field of Search ..... 53/261, 262, 255, 53/263, 243, 242, 539, 246, 247, 448, 443, 474, 473, 475

[56] References Cited

U.S. PATENT DOCUMENTS

| | | | |
|---|---|---|---|
| 4,026,091 | 5/1977 | Pearson | 53/539 X |
| 4,403,462 | 9/1983 | Halbich | 53/539 X |
| 4,446,671 | 5/1984 | Stalder | 53/263 X |
| 4,693,057 | 9/1987 | Rittinger et al. | 53/539 |
| 5,271,209 | 12/1993 | Boyhan | 53/243 X |

*Primary Examiner*—James F. Coan

*Attorney, Agent, or Firm*—Merchant, Gould, Smith, Edell, Welter & Schmidt

[57] ABSTRACT

Apparatus for packaging articles is provided comprising a plate member 10 having a plurality of apertures (12*a*, 12*b*, 12*c*) therein. Each aperture has at least two openings and receives an article or group of articles through a first opening. Each aperture has non-return stop means (20) to releasably retain an article or group of articles therein. Plate member 10 has means to register (32, 34) one or more packages (26) there against so that rotation of plate (10) and package (26) or packages while in registration allows articles (14, 22, 24) in the apertures (12*a*, 12*b*, 12*c*) to move into positions in package (26) pre-determined by the position of the apertures. The invention also provides a process of packaging articles using such a plate member (10).

13 Claims, 2 Drawing Sheets

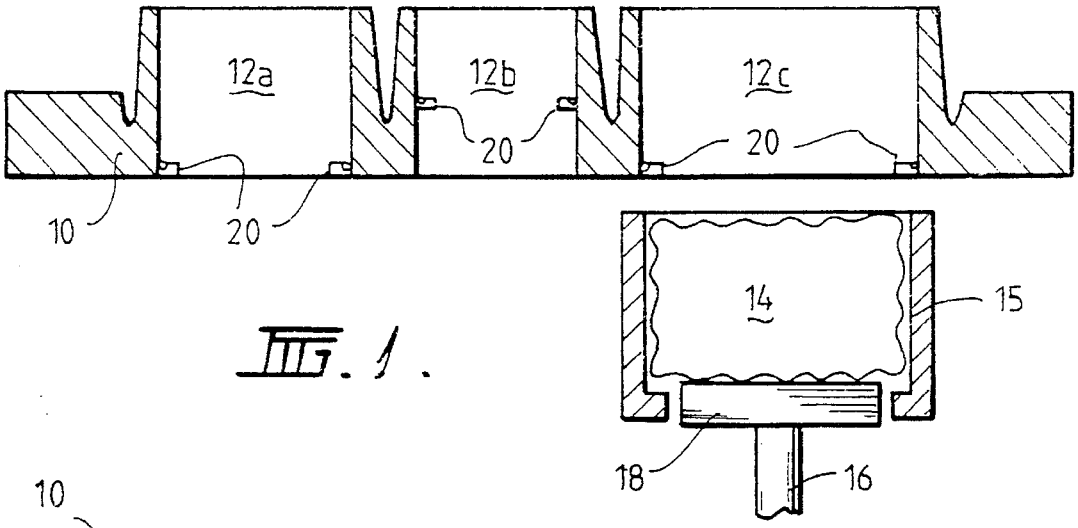
FIG. 1.
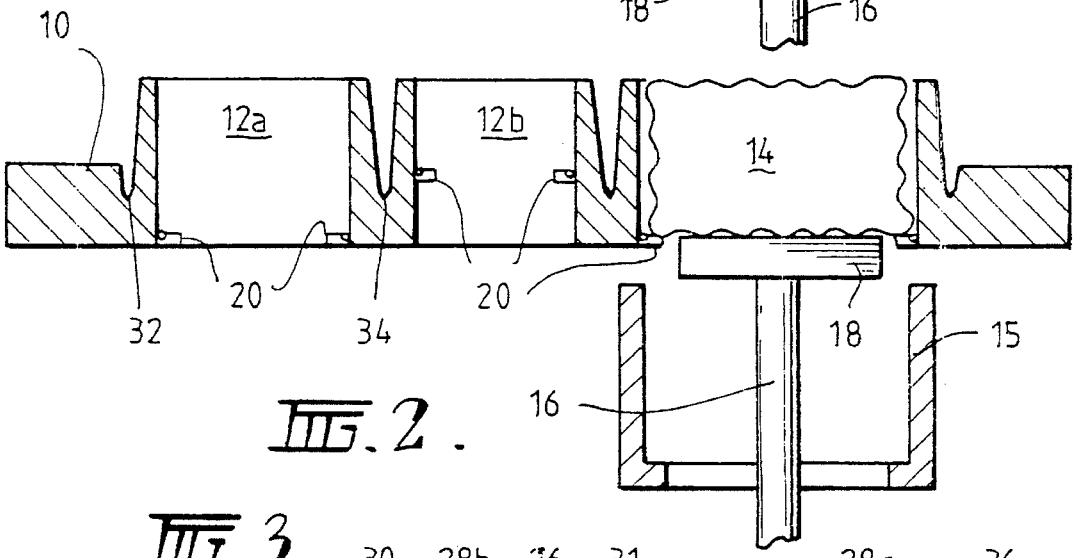
FIG. 2.
FIG. 3.
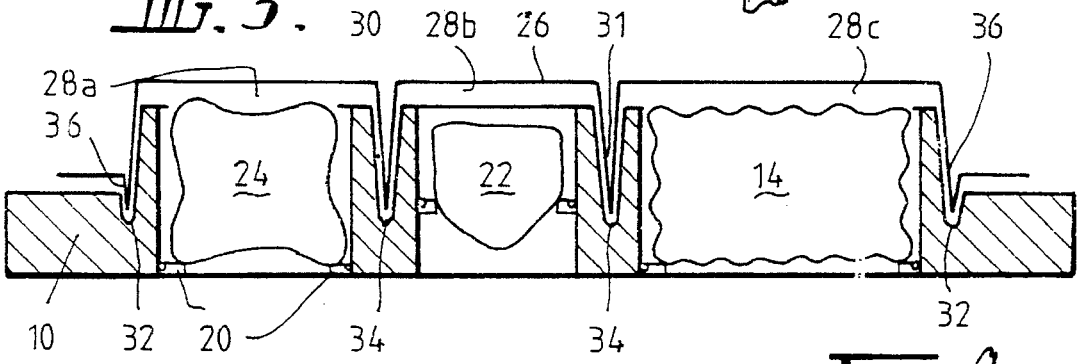
FIG. 4.
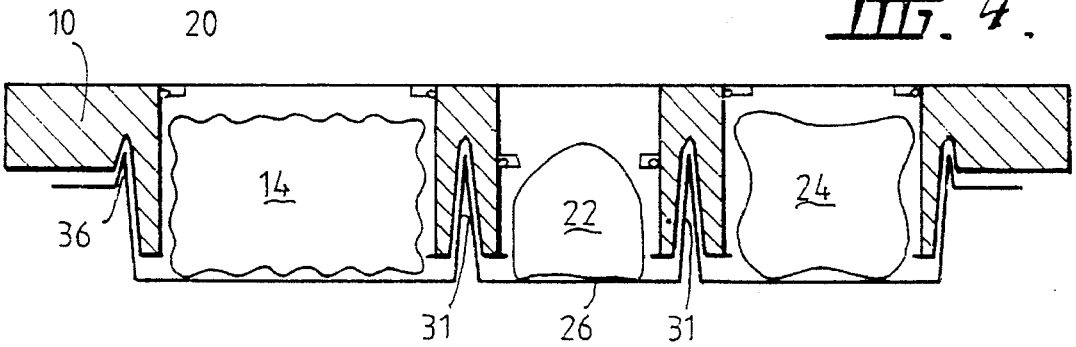

APPARATUS AND PROCESS FOR PACKAGING ARTICLES

This specification relates, in general terms, to apparatus for the packaging of articles. The invention also relates to a process for the packaging of articles. The invention is particularly suitable for the packing of multi-article packages, that is to say, packages which contain more than one article, and, to an apparatus and a process for the packing of articles in such packages, In one embodiment the invention relates to the packaging of a plurality of different type of product in a single package. In another embodiment the invention relates to the packaging of the same product type in a package.

Numerous problems exist when attempting to automate the packaging of articles, whether, the articles are all the same or different. One such problem is the ability to achieve a high packaging speed while maintaining high accuracy in product numbers and orientation in the finished package.

This problem is accentuated where the product is fragile or easily damaged by handling.

Where two or more different articles, or groups of articles, are to be packaged in a single pack, other problem occur. One of these is in relation to the accurate positioning of a package within the apparatus, so that it will correctly receive the articles. A further difficulty concerns the orientation of an article when it is packaged. Certain articles need to be packaged with reference to a specific orientation so that the article is received in the desired manner within the package. In particular, some articles have a distinct bottom surface or a specific shape, and, either the package requires that the article sit on the bottom surface, or, that the shape is such that it will only be received correctly with the one specific orientation.

These problems are discussed in our co-pending application PCT/AU91/00196, the disclosures of which are incorporated herein by reference.

It is an object of this invention to provide apparatus and a process for packaging articles which is suited to automatic operation, and which achieves a high packaging speed with a high rate of accuracy in product numbers and orientation in the finished package.

In accordance with one first aspect of the invention there is provided apparatus for packaging articles comprising a plate member having a plurality of apertures therein, each aperture having at least two openings and being capable of receiving an article, or group of articles, through a first opening thereof;

each said of said apertures having non-return stop means provided therein to releasably retain an article or group of articles positioned therein;

said plate member also having means to register one or more packages thereagainst, whereupon movement of said plate member while in registration with said one or more packages, articles releasably retained within said apertures move therefrom through a second opening therein, into positions in said one or more packages predetermined by the position of said apertures in said plate member.

It will be understood by those skilled in the art that one or more of the apertures in a plate member of the invention may receive either a single article or a group of articles. Reference throughout the remainder of the specification to an article entering, leaving or being positioned in an aperture, is to be construed as including reference to a group of articles entering, leaving or being positioned in such an aperture.

In one embodiment of the plate member of the invention the non-return stop means is a movable means.

In another aspect of the invention there is provided apparatus for packaging articles which includes one or more work station at which a supply of one or more articles to be packaged is provided;

means to position plate member as set out in the one first aspect of the invention described above, at the, or each, work station, together with means to transfer an article into one or more apertures of said plate member though a first opening therein, at each work station, so that is releasably retained therein by the non-return stop means;

means to position one or more packages on said plate member with reference to registration means, together with means to move said plate member and said one or more packages while in registration, so that articles positioned in said apertures move therefrom through a second opening therein to positions in said one or more packages which are predetermined by the position of said apertures in said plate member.

In one embodiment of the apparatus described above the plate member is planer and has a longitudinal axis and each aperture extends longitudinally through said plate member and has three openings, two of which are at the two longitudinal ends of the aperture.

In another embodiment of the apparatus described above, the plate member is generally planer and each aperture extends transversely through the plate member and has two openings therein, one on each face of the plate member.

The non-return stop means employed in the invention may be any suitable means which allows an article or group of articles to enter an aperture through a first opening and which restrains those articles from a return movement through that first opening. Suitable means include pivoted detent means which allow an article to enter the aperture by being pivoted back against the wall of the aperture from a first position, as the article enters, and which then return to said first position whereby to act as a stop means to prevent the article from moving back out of the aperture.

Other non-return stop means may take the form of a resilient protrusion into the aperture which has sufficient flexibility to allow an article to deform the protrusion sufficiently to pass into the aperture, but which, after the article has passed, returns to its initial shape by virtue of its resilience, whereby to prevent any movement of the article back out of the aperture.

In a further embodiment of the invention the plate member is provided to the or each work station in a generally horizontal orientation.

In one particular embodiment of the invention the means to register one or more packages on said plate member includes in its broadest form a cut-away portion or recess, at least around part or all of the peripheral edge of the plate member; the cut-away portion or recess receiving the, or at least part of the, peripheral edge of one or more packages.

In a further particular embodiment of the invention the registration means additionally includes a plurality of grooves formed in the plate member, between the apertures, into which upstanding internal walls of the package or packages will be received upon registration of the package or packages with the plate member.

A particular preferred embodiment of the process and apparatus of the invention is directed to the packaging of groups of three different articles into a pre-shaped tray package. In this context, "pre-shaped" means that the tray package is formed with shapes therein which are pre-formed to accommodate the size of each of the three different articles. The package may contain one or more pre-formed shapes for each article.

In this embodiment of the invention there is provided a plate member having three or more apertures transversely therethrough, of a size corresponding to one of the dimensions of each of the articles to be packaged. The plate member is provided generally horizontally to a first work station. At the work station a group of first articles is positioned and simultaneously moved upwardly through the bottom of the relevant aperture or apertures, of the plate member. Non-return stop means in the form of inwardly projecting resilient plastic detents attached near the bottom of the wall of the, or each, aperture are bent back against the aperture wall as the article is positioned within the aperture, whereupon the resilience of the plastic non-return stop means causes said means to resume an inwardly projecting configuration, whereby to effectively reduce the width of the opening at the bottom of the aperture and prevent the article from moving downwardly out of the aperture.

The plate member may then be moved then to a second work station at which a group of second articles are positioned.

In similar fashion second articles are moved upwardly through the bottom of the aperture or apertures of the plate member which are to receive said second articles. Said aperture or apertures are also provided with inwardly projecting resilient plastic detents which allow the second articles to enter the aperture or apertures by deformation of the resilient detents but which, after the group of articles has passed, resume their original configuration to effectively reduce the width of the opening at the bottom of the aperture or apertures and prevent the group of second articles from moving downwardly therefrom.

Again in similar fashion the plate member may be moved to a third work station at which third articles are positioned in similar fashion in an aperture or apertures in the plate member.

In this embodiment the articles are to be packaged into a single package which is then placed in an inverted form on the top of the plate member and registered against the plate member by a suitable registration means. The plate member and package are then moved, being rotated through 180°, while in registration. The dimensions of the apertures of the plate member are such that the articles retained therein are able to move under the effect of gravity, either with or without vibration or an impact on the plate member, into the pre-formed sections of the package.

As will be clearly understood by those skilled in the art, the location of each of the preformed voids in the tray package corresponds with the location of the relevant apertures in the plate member, thus ensuring correct placement of all of the articles within the desired areas of the package.

Another particularly preferred embodiment of the apparatus and process of the invention relates to the packaging of a plurality of similar articles into a package. In this embodiment, the invention provides a plate member having a plurality of apertures longitudinally therethrough, of a width and height generally corresponding to two of the dimensions of the article to be packaged.

The embodiment is particularly suitable where the articles are generally planer and are to be packed in the package on their edges. The plate member is provided to a work station where a supply of articles is provided stacked on their edges, perhaps under a gravity feed arrangement. Gate means on the gravity feed supply is used to control discharge of the articles from the feed supply. The plate member of the invention is provided adjacent the gate means with one longitudinal end of an aperture aligned with said feed supply, and in a downwardly angled orientation whereupon opening of the gate means allows a plurality of articles to enter the aperture through a first opening under the effect of gravity. It may be desirable to provide means to lower the plurality of articles into said aperture to preserve orientation of the articles and prevent handling damage thereto. Such lowering means may conveniently be in the form of a platen which is extended through the aperture from beneath prior to opening of said gate means. The first article in the feed supply would move onto said platen once the gate opens, and as the platen is withdrawn longitudinally through the aperture, conveniently by being attached to a piston, a plurality of articles from the feed supply enters the aperture. The configuration of the platen would be such that is able to be completely withdrawn from the aperture through a second opening. However that second opening, at the lower end thereof has stop means to prevent the articles from continuing their downward movement so as to retain them within the aperture.

The gate means is controlled in a conventional way to regulate the number of articles allowed to enter the aperture and the first opening may be provided with inwardly directed flexible resilient plastic detents which allow the articles to enter the aperture by pushing back the detents which, when the last article enters, return to their original shape effectively narrowing the opening and preventing articles from passing back through said first opening. This is particularly desirable if the plate member is to resume its original generally horizontal configuration.

One or more packages are then located on top of the plate member, the packages being in an inverted form, and registered against the plate using registration means thereon. While in registration the plate and the package or packages are moved, generally by rotation through 180°, whereby to allow articles contained within the apertures to move under the effect of gravity into pre-determined positions in the package or packages, those positions being determined by the location of the apertures in the plate member.

The invention also extends to a process for packaging articles which may be conveniently employed with the apparatus previously described.

The invention therefore also provides a process for packaging articles comprising;

- positioning a plate member having a plurality of apertures therein, at least at a first work station; said apertures having at least two openings and being capable of receiving an article or group of articles through a first opening thereof;
- positioning and releasably retaining an article or group of articles in one or more of said apertures by means of non-return stop means provided therein;
- positioning and registering one or more packages on said plate member;
- moving said plate member and said one or more packages while in registration whereby to allow articles retained within the apertures to move therefrom through a second opening therein, into said one or more packages, into positions therein predetermined by the position of the said apertures.

To more fully describe the invention reference to specific embodiments will now be had in which the invention is described in relation to the packaging of biscuit type products, with the understanding that the description is purely illustrative, is of preferred embodiments, and in no way restricts the scope of the invention from that previously described.

Reference will be had to the accompanying drawings in which:

FIGS. 1–4 are cross-sectional, cut-away side elevation views of a plate member of the invention. These Figures represent sequential steps in the packaging of articles;

Figure 5:
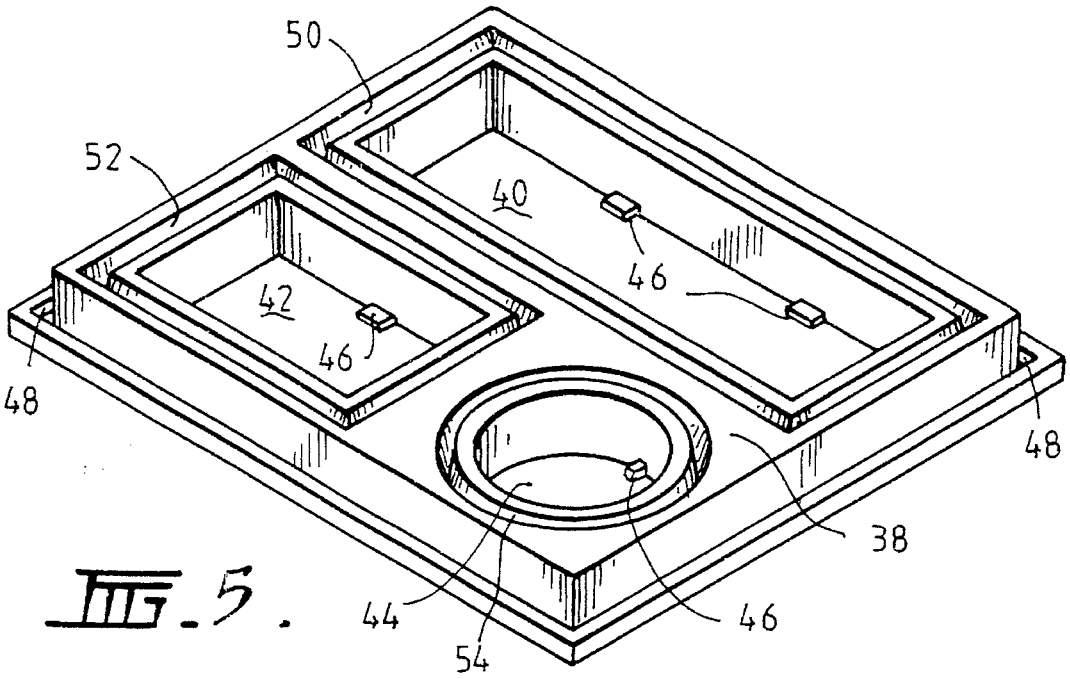
FIG. 5 is an isometric view of a different plate member of the invention.

Referring to the drawings and to FIG. 1 there is seen a plate 10, containing a plurality of apertures 12*a*, 12*b* and 12*c*. In FIG. 1, plate 10 is positioned at a first work station which is provided with a group of first articles 14, which are regular, scalloped edged biscuits. These are provided to the work station in chute 15, seen in cross-section, at right angles to the plane of the drawing and are positioned underneath plate 10.

When plate 10 has been correctly positioned, piston 16 is actuated and platen 18 lifts a selected number of articles 14 vertically upward, the number of articles 14 being determined by the width of aperture 12*c* which cannot be seen from this cross-sectional view. The biscuits are lifted together and move into aperture 12*c* as seen in FIG. 2.

Apertures 12*a*–12*c* are provided with a plurality of hinged detent members 20, shown schematically, which in their normal position extend into the bottom portions of apertures 12*a*–12*c*. As articles 14 move into aperture 12*c* detents 18 and 20 hinge upwardly to allow articles 14 to enter aperture 12*c*. When the bottom edges of articles 14 pass detents 20 in aperture 12*c* they hinge back to their original position to effectively reduce the size of the bottom opening of aperture 12*c*, to a size which will not allow articles 14 to pass back down through the opening. This is also seen in FIG. 2.

Plate 10 is then moved, while being maintained in a generally horizontal orientation, to a second and then a third work station (not shown) where second articles 22 and third articles 24 are respectively positioned in apertures 12*b* and 12*a*.

At this stage all apertures in plate 10 have had articles positioned therein as seen in FIG. 3.

As also seen in FIG. 3, a package 26 containing preformed voids 28*a*, 28*b* and 28*c* and internal walls 30 and 31 is positioned over plate 10 and registered therewith.

Registration is achieved by virtue of the fact that plate 10 has a peripheral cut-away portion or groove 32 and has grooves 34 in the top surface of the plate adjacent cavities 12*a*, 12*b* and 12*c*. When package 26 is positioned over plate 10 the upstanding peripheral wall 36 of package 26, are received in cut-away portion or groove 32 of plate 10. Internal walls 30 and 31 of package 26 are received, at least to some extent, in grooves 34. Both of these features provide positive registration of package 26 with plate 10.

In FIG. 4, plate 10 and package 26 while in registration, have been moved by rotation through approximately 180°. Under the effect of gravity, articles 14, 22 and 24 have moved out of apertures 12*a*, 12*b* and 12*c* respectively and into voids 28*a*, 28*b* and 28*c* respectively of package 26. Plate 10 may then be lifted vertically to enable packaging 26 containing articles 14, 22 and 24 to be subject to sealing of the package, as required.

It will be appreciated that the desired positioning of the articles within package 26 must occur in accordance with the internal layout of package 26. The position of articles 14, 22 and 24 is controlled by the position of apertures 12*a*, 12*b* and 12*c* in plate 10, as is apparent.

Plate 10 may again be rotated through approximately 180° to place it in a condition to be forwarded onto a first work station, to repeat the process described above.

Turning to FIG. 5 there is shown in isometric top view, a plate 38 in accordance with the invention, which is not plate 10 as shown in FIG. 1–4. In this simple illustrative version of the invention plate 38 is used for the packaging of three articles into a single package.

Plate 38 contains apertures 40, 42 and 44 which extend transversely through plate 38 and have an opening on each face thereof.

In a similar manner to the process of the invention set out above, plate 38 is delivered to a first work station where at least one of the articles to be received in apertures 40, 42 or 44 is or are positioned therein and releasably retained by means of non-return means 46. Once plate 38 contains all the articles required, by either further loading at the first work station or by moving plate 38 to subsequent work stations, a package (not shown) is placed over the top of plate 38. As can be seen from FIG. 5 a groove 48 has been provided around the periphery of plate 38, together with a groove 50 around aperture 40, a groove 52 around aperture 42 and a groove 54 around aperture 44. Upstanding internal walls of the package are received within grooves 50, 52 and 54 as well as the peripheral wall of the package being received within groove 48. The location of the peripheral edge and upstanding walls of the package in these grooves ensures accurate registration of the package with the plate 38.

While in registration the package and plate 38 are inverted and under the effect of gravity the articles contained in apertures 40, 42 and 44 move into corresponding voids formed by the internal walls of the package. The plate may then be removed to allow sealing of the package as required.

Figure 6B:
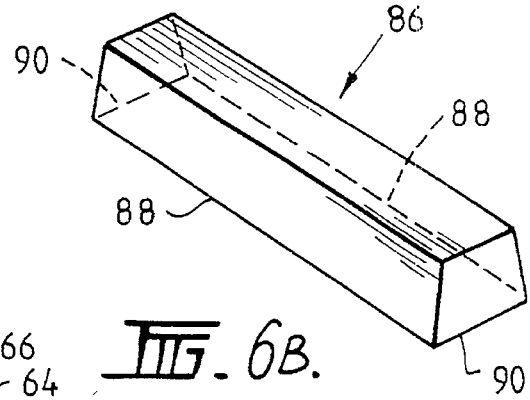
FIG. 6B is a similar isometric view to FIG. 6A, of an inverted package for the articles in one of the apertures of the plate member of FIG. 6A.
Figure 6A:
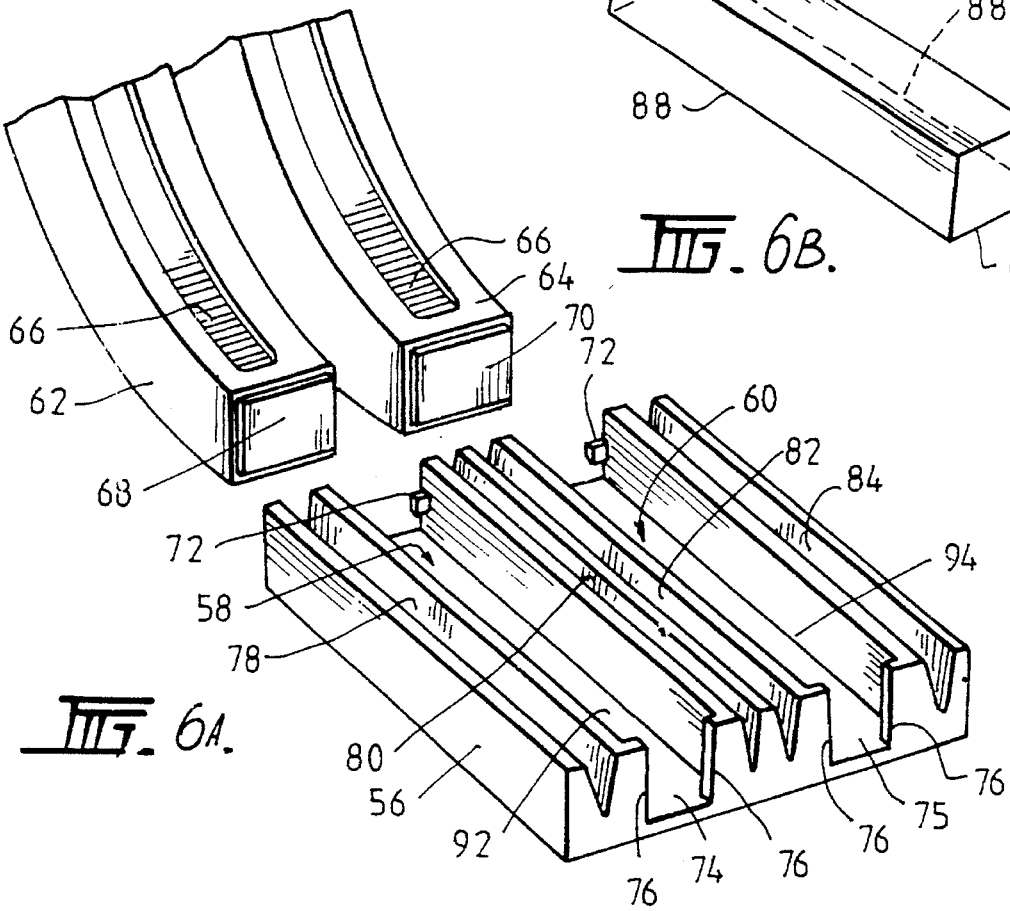
FIG. 6A is an isometric view showing a further variation in the plate member of the invention and preferred article loading arrangement.

Referring to FIG. 6A there is shown a further plate 56 in accordance with the invention. Plate 56 has two longitudinal apertures extending therethrough 58 and 60. Each of apertures 58 and 60 has three opening, one at each longitudinal end and a third opening along the top of plate 56.

As sen in FIG. 6A plate 56 is tilted and in use is positioned against feed chutes 62 and 64 which are gravity fed with articles 66 to be packaged.

Plate 56 is positioned with feed chute 62 being aligned with aperture 58 and feed chute 64 being aligned with aperture 60. Gate means 68 and 70 control the release of articles 66 from feed chutes 62 and 64.

In use, gates 68 and 70 are opened and articles 66 move through openings 59 and 61 into apertures 58 and 60 respectively, under the effect of gravity. There may optionally be provided two piston means (not shown) which when extended through each of apertures 58 and 60 provides a platen closely adjacent each of gates 68 and 70. When gates 68 and 70 open, articles 66 move down feed chutes 62 and 64 to rest against the platens so that controlled withdrawal of the platens through apertures 58 and 60 allows for a controlled movement of articles 66 into apertures 58 and 60.

Articles 66 deflect non-return stop means 72 as they enter apertures 58 and 60.

The width of apertures 58 and 60 is reduced at the other longitudinal ends 74 and 75, by stop flanges 76.

Plate 56 is also provided with four longitudinal grooves 78, 80, 82 and 84 positioned each side of apertures 58 and 60.

After apertures 58 and 60 are filled with the desired number of articles 66, plate 56 is lowered to a generally horizontal orientation and two of packages 86 as shown in FIG. 6B in an inverted position, are placed separately over apertures 58 and 60 with the side walls 88 of the packages located in grooves 78 and 80 in respect of the package over aperture 58 and in grooves 82 and 84 in respect of the package located over aperture 60. In both cases the end walls 90 of the package extend beyond plate 56.

While the packages and plate 56 are in registration they are rotated through 180° which allows articles 66 to leave apertures 58 and 60 through openings 92 and 94 respectively and to enter the packages under the effect of gravity.

Various modifications may be made to the apparatus and process of the invention, and all are to be considered within the scope of the invention. Illustrative of such are the many known ways of releasably retaining an article or group of articles with an aperture of the plate member. Such means include spring biased means, friction pads, pneumatically operated cylinder means, rubber or plastic push-part flaps.

I claim:

1. Apparatus for packaging articles comprising a plate member having a plurality of apertures therein, each aperture having at least two openings and being capable of receiving an article or group of articles through a first opening thereof;

said apertures having non-return stop means provided therein to releasably retain an article or group of articles positioned therein; said plate member also having means to register one or more packages thereagainst, whereupon movement of said plate member while in registration with the said one or more packages, articles releasably retained within said apertures move therefrom through a second opening therein to a position in said one or more packages predetermined by the position of said apertures in said plate member.

2. Apparatus as claimed in claim 1 wherein each of said apertures has a longitudinal axis; the said longitudinal axes of said apertures being substantially parallel.

3. Apparatus as claimed in claim 1 or claim 2 wherein said apertures extend longitudinally through the length of the plate member.

4. Apparatus as claimed in claim 1 or claim 2 wherein said apertures extend transversely through the thickness of said plate member.

5. Apparatus as claimed in any one of claims 1 or 2 wherein said non-return stop means consist of one or more resilient deformable members.

6. Apparatus as claimed in any one of claim 1 wherein said means to register one or more pages comprises one or more cut-away portions located near the edges of said plate member.

7. Apparatus as claimed in claim 6 wherein said means to register one or more packages further comprises one or more cut out portions in the plate surface between the apertures thereon, into which upstanding internal walls of the package or packages may be received.

8. Apparatus for packaging articles comprising one or more work stations at which a supply of one or more articles to be packaged is provided;

means to position a plate member as claimed in claim 1 at the, or each, work station;

means to transfer one or more articles to one or more aperture of said plate member through a first opening thereof so that the article or articles are releasably retained therein by said non-return stop means;

means to register one or more packages on said plate member by means of said registration means thereon;

means to move said plate member and said one or more packages while in registration, so that articles positioned in said apertures move therefrom through a second opening therein, to positions in said one or more packages predetermined by the position of said apertures in said plate member.

9. Apparatus as claimed in claim 8 wherein the means to position the plate member at the or each work station positions said plate member in a generally horizontal orientation at each work station.

10. Apparatus as in claim 8 wherein said means to position the plate member at the or each work station positions said plate member at an inclined angle at the or each work station.

11. A method of packaging articles comprising loading, at a first workstation, one or more articles into one or more apertures in a plate member having a plurality of apertures therein, each aperture having at least two openings and being capable of receiving an article or group of articles through the first opening thereof; said aperture having non-return stop means provided therein to releasably retain an article or group of articles positioned therein; said plate member also having means to register one or more packages thereagainst; the loading of said one or more articles being through said first opening in said one or more apertures; positioning one or more packages against said plate member, in registration therewith; moving said plate member while in registration with said one or more packages to a position that enables articles within said aperture or apertures to move therefrom through a second opening therein to positions in said one or more packages predetermined by the position of said aperture or apertures in said plate member, and removing said package or packages and articles from registration with said plate member.

12. A method as claimed in claim 11 wherein different articles are positioned in said apertures at different work stations.

13. A method as claimed in claim 11 wherein a single package is positioned against said plate member and all articles carried by the plate member are transferred to said package.

* * * * *